US012624870B2

(12) United States Patent
Sekimoto

(10) Patent No.: US 12,624,870 B2
(45) Date of Patent: May 12, 2026

(54) COOLING DEVICE

(71) Applicant: SHIMADZU CORPORATION, Kyoto (JP)

(72) Inventor: Shunsuke Sekimoto, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 100 days.

(21) Appl. No.: 18/705,935

(22) PCT Filed: Jun. 27, 2022

(86) PCT No.: PCT/JP2022/025509
§ 371 (c)(1),
(2) Date: Apr. 29, 2024

(87) PCT Pub. No.: WO2023/074049
PCT Pub. Date: May 4, 2023

(65) Prior Publication Data

US 2024/0418419 A1 Dec. 19, 2024

(30) Foreign Application Priority Data

Oct. 29, 2021 (JP) ..... 2021-177164

(51) Int. Cl.
*F25B 41/30* (2021.01)
*F25B 1/00* (2006.01)

(52) U.S. Cl.
CPC ..... *F25B 41/30* (2021.01); *F25B 1/00* (2013.01); *F25B 2400/051* (2013.01)

(58) Field of Classification Search
CPC ..... F25B 41/31; F25B 41/335; F25B 41/33; F25B 1/00; F25B 2400/051; F25B 2400/16; F25B 43/006; F25B 2600/2523
See application file for complete search history.

(56) References Cited

U.S. PATENT DOCUMENTS 3,688,517 A * 9/1972 Newton ..... F25B 41/22 62/217
5,816,313 A * 10/1998 Baker ..... F28D 15/043 165/41

OTHER PUBLICATIONS

Fujii et al., "Research on Temperature Control by Steam Valve Operation of a Fluid Loop Type Exhaust Heat System Using Latent Heat", JAXA Contract Report, Japan Aerospace Exploration Agency, Oct. 2004, JAXA-CR-04-002.
Written Opinion by the International Search Authority for PCT application No. PCT/JP2022/025509 dated Jun. 9, 2022.

* cited by examiner

*Primary Examiner* — Miguel A Diaz
(74) *Attorney, Agent, or Firm* — Muir Patent Law, PLLC

(57) ABSTRACT

This cooling device is equipped with a tank, a pump, an evaporator, and a condenser. The gas phase portion of the tank is filled with a filler gas and is equipped with a volume-changing unit. The volume-changing unit is configured to adjust an evaporation temperature of the refrigerant by changing a pressure of the refrigerant, which is achieved by changing a volume of the gas phase portion to change a pressure of the filler gas.

8 Claims, 2 Drawing Sheets

COOLING DEVICE

TECHNICAL FIELD

The present invention relates to a cooling device.

BACKGROUND ART

Conventionally, a cooling device equipped with an evaporator and a condenser has been disclosed. Such a cooling device is disclosed, for example, in Terushige FUJII, and three others, a "Research on Temperature Control by Steam Valve Operation of a Fluid Loop Type Exhaust Heat System Using Latent Heat," a JAXA Contract Report, Japan Aerospace Exploration Agency, Oct. 29, 2004, JAXA-CR-04-002 (hereinafter simply referred to as "Non-Patent Document 1").

The above Non-Patent Document 1 discloses a cooling device equipped with a pump, an evaporator, a condenser, and a valve. In the above Non-Patent Document 1, the refrigerant supplied from the pump evaporates by absorbing the thermal load in the evaporator and condenses in the condenser. Further, the condensed refrigerant returns to the pump and is sent out again to repeat the circulation. Further, in the above-described Non-Patent Document 1, a valve is provided between the evaporator and the condenser, and it changes the pressure of the refrigerant inside the evaporator and the evaporation temperature of the refrigerant by changing its opening degree. Further, in the above-described Non-Patent Document 1, the temperature at the surface of the evaporator (i.e., the cooling temperature) is adjusted by adjusting the evaporation temperature of the refrigerant by operating the valve opening between the evaporator and the condenser.

PRIOR ART DOCUMENT

Patent Document

Non-Patent Document 1: Terushige FUJII, and other three persons, "Study on Temperature Control by Steam Valve Operation of a Fluid Loop Type Heat Exhaust System Using Latent Heat," a JAXA Contract Report, Japan Aerospace Exploration Agency, Oct. 29, 2004, JAXA-CR-04-002

SUMMARY OF THE INVENTION

Problems to be Solved by the Invention

However, in the cooling device described in the above Non-Patent Document 1, since the evaporation temperature of the refrigerant is adjusted by operating the valve opening between the evaporator and the condenser, there is an inconvenience that the pressure boost amount (pressure increase amount) of the refrigerant by the pump becomes large due to the pressure loss at the valve. In this case, the pump become larger, making it impossible to adjust the cooling temperature while reducing the size of the pump.

This present invention has been made to solve the above problems. One object of the present invention is to provide a cooling device capable of adjusting the cooling temperature in two-phase cooling using the phase change when the refrigerant changes from liquid to gas while reducing the size of the pump.

Means for Solving the Problems

In order to attain the above objects, a cooling device according to one aspect of the present invention, comprises a tank configured to store a liquid refrigerant;

a pump configured to discharge the liquid refrigerant stored in the tank;

an evaporator configured to cool a cooling target by evaporating the liquid refrigerant discharged from the pump; and a condenser configured to condense a gaseous refrigerant generated by the refrigerant evaporated by the evaporator, wherein a gas phase portion of the tank is filled with a filler gas and is equipped with a volume-changing unit, the volume-changing unit being configured to adjust an evaporation temperature of the refrigerant by changing a pressure of the refrigerant, which is achieved by changing a volume of the gas phase portion to change a pressure of the filler gas.

Effects of the Invention

In the cooling device according to the above-described one aspect of the present invention, the gas phase portion of the tank is filled with a filler gas. This allows the pressure of the refrigerant to be increased by the pressure (partial pressure) of the filler gas in the gas phase portion of the tank, so the pressure boost amount (pressure increase amount) of the refrigerant by the pump can be reduced by the pressure (partial pressure) of the filler gas. As a result, the pump can be made smaller. Further, a volume-changing unit is equipped with the gas phase portion of the tank, the volume-changing unit being configured to adjust an evaporation temperature of the refrigerant by changing a pressure of the refrigerant, which is achieved by changing a volume of the gas phase portion to change a pressure of the filler gas. With this, it becomes possible to adjust the cooling temperature by adjusting the evaporation temperature of the refrigerant by the volume-changing unit and the filler gas. As a result, in two-phase cooling using the phase change when the refrigerant changes from liquid to gas, the cooling temperature can be regulated while downsizing the pump. Note that in the case of using a refrigerant (such as carbon dioxide) with a large increase rate of the saturation pressure relative to the temperature increase, the pressure boost amount of the refrigerant by the pump tends to become larger. For this reason, this configuration is particularly effective when using a refrigerant, such as carbon dioxide, with a large increase in the saturation pressure relative to the temperature increase.

EMBODIMENTS FOR CARRYING OUT THE INVENTION

Hereinafter, some embodiments in which the present invention is embodied will be described based on the attached drawings.

Referring to FIG. 1 to FIG. 4, a cooling device 100 according to one embodiment of the present invention will be described.

(Configuration of Cooling Device)

Figure 1:
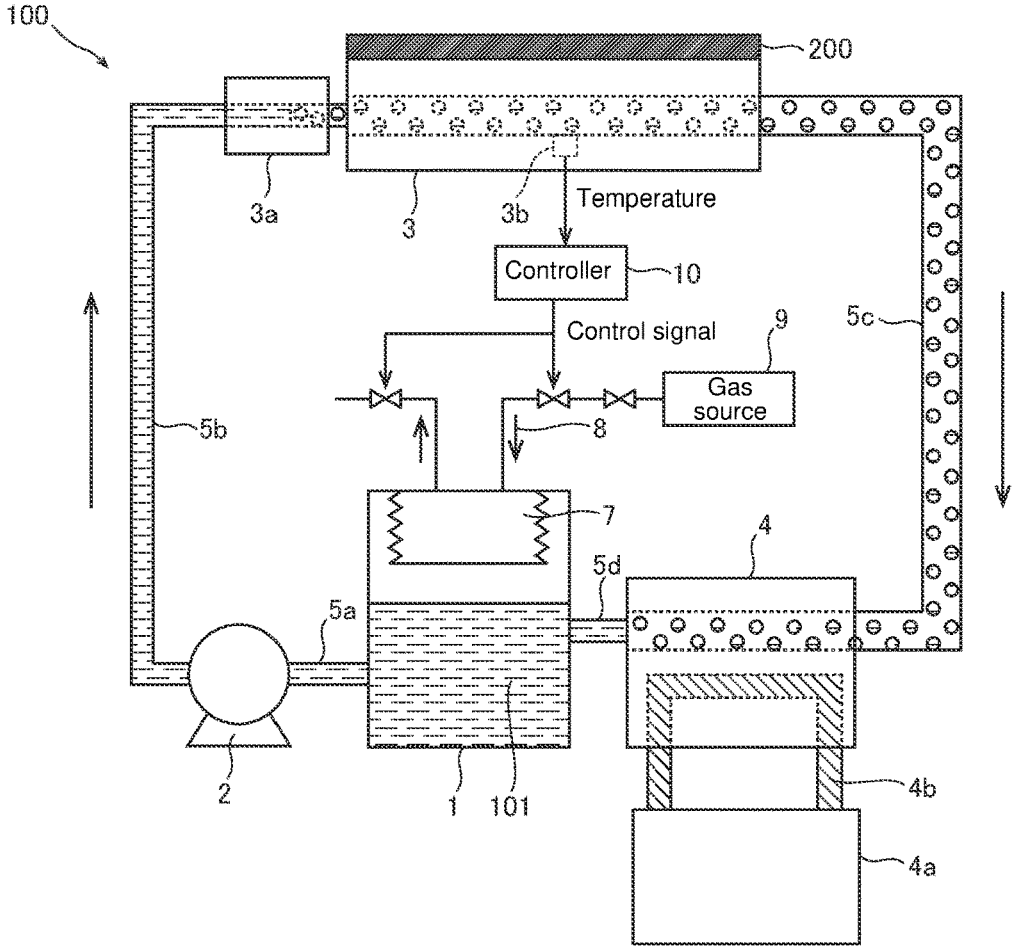
FIG. 1 is a diagram showing a cooling device according to one embodiment.

As shown in FIG. 1, the cooling device 100 is a two-phase cooling device utilizing the phase change of the refrigerant 101 as it changes from liquid to gas. Specifically, the cooling device 100 is equipped with a tank 1, a pump 2, an evaporator 3, and a condenser 4. The refrigerant 101 is not specifically limited but can be, for example, carbon dioxide, which is a natural refrigerant. Further, the cooling device 100 can be applied to cooling, for example, but not limited to, space equipment and production equipment for mechanical components.

The tank 1 is made of metal and is configured to store a liquid refrigerant 101. Further, the tank 1 is connected to the pump 2 via the refrigerant piping 5*a*.

The pump 2 is configured to draw in the liquid refrigerant 101 stored in the tank 1 and to discharge the drawn liquid refrigerant 101 toward the evaporator 3. The pump 2 is not particularly limited and can be, for example, a volumetric or centrifugal pump. Further, the pump 2 is connected to the evaporator 3 via the refrigerant piping 5*b*.

The evaporator 3 is configured to cool the cooling target 200 by evaporating the liquid refrigerant 101 discharged from the pump 2. The cooling target 200 is a heat-generating element such as an electronic device. The evaporator 3 functions as a heat exchanger that exchanges heat between the cooling target 200 and the refrigerant 101. In other words, the evaporator 3 is configured to receive heat from the cooling target 200 and evaporate the refrigerant 101. The evaporator 3 is connected to the condenser 4 via the refrigerant piping 5*c*. Note that in the refrigerant piping 5*c*, the refrigerant 101 is in a gas-liquid two-phase flow state in which a liquid refrigerant 101 and a gaseous refrigerant 101 are mixed together.

Further, a preheater 3*a* is provided on the upstream side of the evaporator 3. The preheater 3*a* is configured to preheat the liquid refrigerant 101 that flows into the evaporator 3. The preheater 3*a* is configured to preheat the liquid refrigerant 101 to promote the evaporation of the refrigerant 101 in the evaporator 3.

Further, the evaporator 3 is equipped with a temperature sensor 3*b* for detecting the temperature of the evaporator 3 or the temperature of the refrigerant 101 in the evaporator 3. The temperature sensor 3*b* is configured to output the detected temperature of the evaporator 3 or the temperature of the refrigerant 101 in the evaporator 3 to the controller 10 described below.

The condenser 4 is configured to condense the gaseous refrigerant 101 obtained by evaporating the refrigerant in the evaporator 3. The condenser 4 functions as a heat exchanger that exchanges heat between the brine 4*b* of the refrigeration machine 4*a* and the refrigerant 101. In other words, the condenser 4 is configured to transfer heat to the brine 4*b* and thereby condense the refrigerant 101. Further, the condenser 4 is connected to the tank 1 via the refrigerant piping 5*d*.

The cooling device 100 is configured to cool the cooling target 200 by repeating a circulation cycle in which the refrigerant 101 delivered from the tank 1 is circulated in the order of the pump 2, the evaporator 3, and the condenser 4, and then returned to the tank 1 again. Further, the cooling device 100 is configured to adjust the temperature of the cooling target 200 by adjusting the evaporation temperature of the refrigerant 101 by adjusting the pressure of the refrigerant 101.

Figure 2:
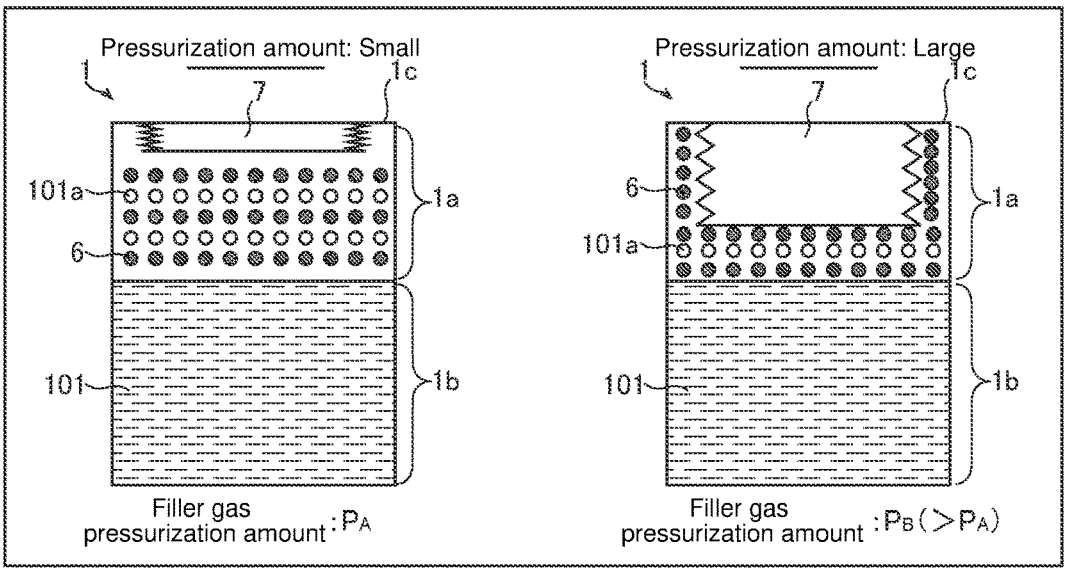
FIG. 2 is a diagram for explaining volume changes of a gas phase portion of a tank by a volume-changing unit of the cooling device according to one embodiment.

Here, in this embodiment, as shown in FIG. 1 and FIG. 2, in the gas phase portion 1*a* of the tank 1, a filler gas 6 is filled, and a volume-changing unit 7 is provided. The volume-changing unit 7 is configured to change the volume of the gas phase portion 1*a*, thereby changing the pressure of the filler gas 6 to change the pressure of the refrigerant 101, which in turn regulates the evaporation temperature of the refrigerant 101. The filler gas 6 is an inert gas that neither reacts with the refrigerant 101 nor condenses due to the volume changes of the gas phase portion 1*a* by the volume-changing unit 7. The evaporation temperature of the filler gas 6 is lower than the evaporation temperature of the refrigerant 101 at the same pressure. In this embodiment, the filler gas 6 is nitrogen. Further, the volume-changing unit 7 is installed on the ceiling 1*c* of the tank 1, avoiding the liquid phase portion 1*b* where the liquid refrigerant 101 is stored. Note that in FIG. 2, for ease of understanding, the filler gas 6 present in the gas phase portion 1*a* is indicated with hatched circles, and the gaseous refrigerant 101 (referred to as the refrigerant 101*a* for convenience) present in the gas phase portion 1*a* is indicated with white circles.

Further, in this embodiment, the volume-changing unit 7 is designed to change the volume of the gas phase portion 1*a* by being expanded and contracted by the volume-changing gas 8. Specifically, the volume-changing unit 7 is configured so that when the volume-changing gas 8 is supplied from the gas source 9 into the interior of the volume-changing unit 7, the volume-changing unit 7 deforms to expand and increase in volume, thereby reducing the volume of the gas phase portion 1*a*. Conversely, when the volume-changing gas 8 is discharged from the interior to the exterior of the volume-changing unit 7, the volume-changing unit 7 deforms to contract and decrease in volume, thereby increasing the volume of the gas phase portion 1*a*. Note that the volume-changing unit 7 is configured to be expanded and contracted within the range of the gas phase portion 1*a* (i.e., within the range not touching the liquid surface of the liquid-phase refrigerant 101). The maximum volume (volume at maximum expansion) of the volume-changing unit 7 is less than the volume of the tank 1. Depending on the size of the cooling device 100, for example, it is possible to install the volume-changing unit 7 with a maximum volume of 4 liters, with respect to the 6-liter volume of the tank 1.

Further, in this embodiment, the volume-changing gas 8 is nitrogen. In this case, as the gas source 9, it is possible to employ a nitrogen gas cylinder filled with a nitrogen gas, and a nitrogen gas supply system that extracts a nitrogen gas from the air and supplies it.

Here, let $V_A$ be the volume of the gas phase portion 1*a* in the state where the volume-changing unit 7 is contracted, and let $P_A$ be the pressure (partial pressure) of the filler gas 6 in the gas phase portion 1*a* at that time. Further, let $V_B$ be the volume of the gas phase portion 1*a* in the state where the volume-changing unit 7 is extended, and let $P_B$ be the pressure (partial pressure) of the filler gas 6 in the gas phase portion 1*a* at that time. Further, since the amount of the filler gas 6 is constant in the gas phase portion 1*a*, the relation: $P_A \times V_A = P_B \times V_B$ is established according to Boyle's law. Therefore, when the volume of the gas phase portion 1*a* decreases from $V_A$ to $V_B$ due to the changes in the volume-changing unit 7 from the contracted state to the extended state, the pressure (partial pressure) of the filler gas 6 increases from $P_A$ to $P_B$. Note that when the volume-changing unit 7 changes from the contracted to the extended state, the refrigerant 101*a* in the gas phase portion 1*a* condenses and changes to the liquid refrigerant 101. Therefore, the pressure (partial pressure) of the refrigerant 101*a* does not change.

The increase in the pressure (partial pressure) of the filler gas 6 from $P_A$ to $P_B$ causes an increase in the pressurization amount of the liquid refrigerant 101 in the tank 1 by the filler gas 6. Therefore, when the pressure (partial pressure) of the filler gas 6 increases from $P_A$ to $P_B$, it is possible to not only increase the pressure of the refrigerant 101 but also to raise the evaporation temperature of the refrigerant 101, which varies depending on the pressure. Although the detailed description will be omitted, when the pressure (partial pressure) of the filler gas 6 decreases from $P_B$ to $P_A$, the evaporation temperature of the refrigerant 101 can be reduced.

Figure 3:
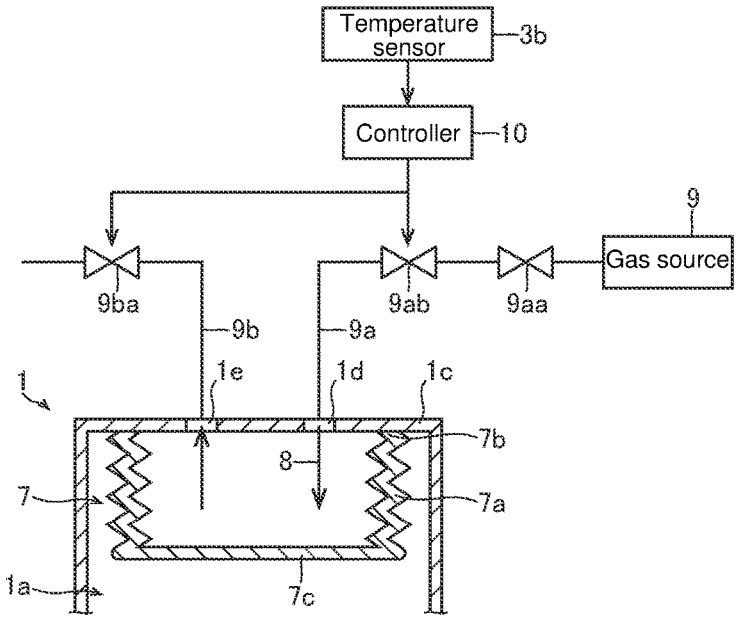
FIG. 3 is a cross-sectional view showing the volume-changing unit of the cooling device according to one embodiment.

Further, in this embodiment, the volume-changing unit 7 is a metal bellows. Specifically, as shown in FIG. 3, the volume-changing unit 7 is a hollow tubular member having a corrugated (bellows-like) wall 7*a*, characterized by alternating mountain and valley folds. The tube wall 7*a* is mounted on the ceiling 1*c* of the tank 1 in an extendable and retractable manner along the vertical direction. Further, the volume-changing unit 7 has one end 7*b*, serving as a fixed end, mounted on the ceiling 1*c* of the tank 1, and the other end portion 7*c*, acting as a movable end, configured to move vertically within the tank 1. Further, the other end portion 7*c* is formed in a plate shape and is designed to seal the other end side of the tube wall 7*a*. The interior of the volume-changing unit 7, partitioned by the tube wall 7*a* and the other end portion 7*c*, is isolated from the interior of the tank 1 by the tube wall 7*a* and the other end portion 7*c* to prevent the circulation of fluids (both liquids and gases).

Further, the ceiling 1*c* of the tank 1 is equipped with an opening portion 1*d* for supplying a volume-changing gas 8 from the gas source 9 to the interior of the volume-changing unit 7 and an opening portion 1*e* for discharging the volume-changing gas 8 from the interior to the exterior of the volume-changing unit 7. The volume-changing unit 7 is connected to the gas source 9 via the opening portion 1*d* that communicates between the interior of the volume-changing unit 7 and the gas supply piping 9*a*, which is connected to the gas source 9. Further, in the middle of the gas supply piping 9*a*, there is provided a regulator 9*aa* for adjusting the pressure of the volume-changing gas 8 supplied from the gas source 9 and a gas supply valve 9*ab* for controlling the supply of the volume-changing gas 8 from the gas source 9 to the volume-changing unit 7. The gas supply valve 9*ab* is configured to open and close under the control of the controller 10. Further, when the gas supply valve 9*ab* is opened, and the volume-changing gas 8 is supplied from the gas source 9 to the interior of the volume-changing unit 7, the tube wall 7*a* of the volume-changing unit 7 is deformed to expand, thereby increasing the volume of the volume-changing unit 7. Note that in the case where the pressure of the volume-changing gas 8 after the adjustment by the regulator 9*aa* is not sufficient to change the volume of the volume-changing unit 7, a pressure boosting mechanism, such as a compressor, may be installed downstream of the regulator 9*aa* in the gas supply piping 9*a*.

Further, the volume-changing unit 7 is connected to the exterior (atmosphere) via the opening portion 1*e* that communicates with the interior of the volume-changing unit 7 and the gas discharge piping 9*b*, which is connected (open) to the exterior (atmosphere). In the middle of the gas discharge piping 9*b*, there is provided a gas discharge valve 9*ba* that controls the discharge of the volume-changing gas 8 from the volume-changing unit 7 to the exterior (atmosphere). The gas discharge valve 9*ba* is configured to open and close under the control of the controller 10. Further, when the gas discharge valve 9*ba* opens, the internal pressure of the gas phase portion 1*a* of the tank 1 causes the tube wall 7*a* of the volume-changing unit 7 to deform and shrink, causing the discharge of the volume-changing gas 8 inside the volume-changing unit 7, thereby reducing the volume of the volume-changing unit 7.

Further, in this embodiment, the volume-changing unit 7 is configured to adjust the evaporation temperature of the refrigerant 101 by changing the volume of the gas phase portion 1*a*, which is achieved by changing the volume of the volume-changing gas 8, so that the temperature of the evaporator 3 or the temperature of the refrigerant 101 in the evaporator 3 becomes the target temperature. Specifically, the controller 10 is configured to adjust the opening degree of the gas supply valve 9*ab* and the gas discharge valve 9*ba* so that the temperature of the evaporator 3 or the temperature of the refrigerant 101 in the evaporator 3 becomes the target temperature. This adjustment is made based on the temperature of the evaporator 3 detected by the temperature sensor 3*b* or the temperature of the refrigerant 101 in the evaporator 3. With this, the volume-changing unit 7 changes in its volume by the volume-changing gas 8 so that the temperature of the evaporator 3 or the temperature of the refrigerant 101 in the evaporator 3 becomes the target temperature.

For example, when the temperature of the evaporator 3 detected by the temperature sensor 3*b* or the temperature of the refrigerant 101 in the evaporator 3 is lower than the target temperature, the controller 10 performs control to increase the evaporation temperature of the refrigerant 101 by opening the gas supply valve 9*ab*. With this, since the evaporation temperature of the refrigerant 101 is raised, the temperature of the evaporator 3 or the temperature of the refrigerant 101 in the evaporator 3 can be raised. Therefore, it becomes possible to bring the temperature of the evaporator 3 or the temperature of the refrigerant 101 in the evaporator 3 closer to the target temperature. Further, for example, when the temperature of the evaporator 3 detected by the temperature sensor 3*b* or the temperature of the refrigerant 101 in the evaporator 3 exceeds the target temperature, the controller 10 performs control to lower the evaporation temperature of the refrigerant 101 by opening the gas discharge valve 9*ba*. With this, since the evaporation temperature of the refrigerant 101 is lowered, the temperature of the evaporator 3 or the temperature of the refrigerant 101 in the evaporator 3 can be lowered. Therefore, it becomes possible to bring the temperature of the evaporator 3 or the temperature of the refrigerant 101 in the evaporator 3 closer to the target temperature.

Figure 4:
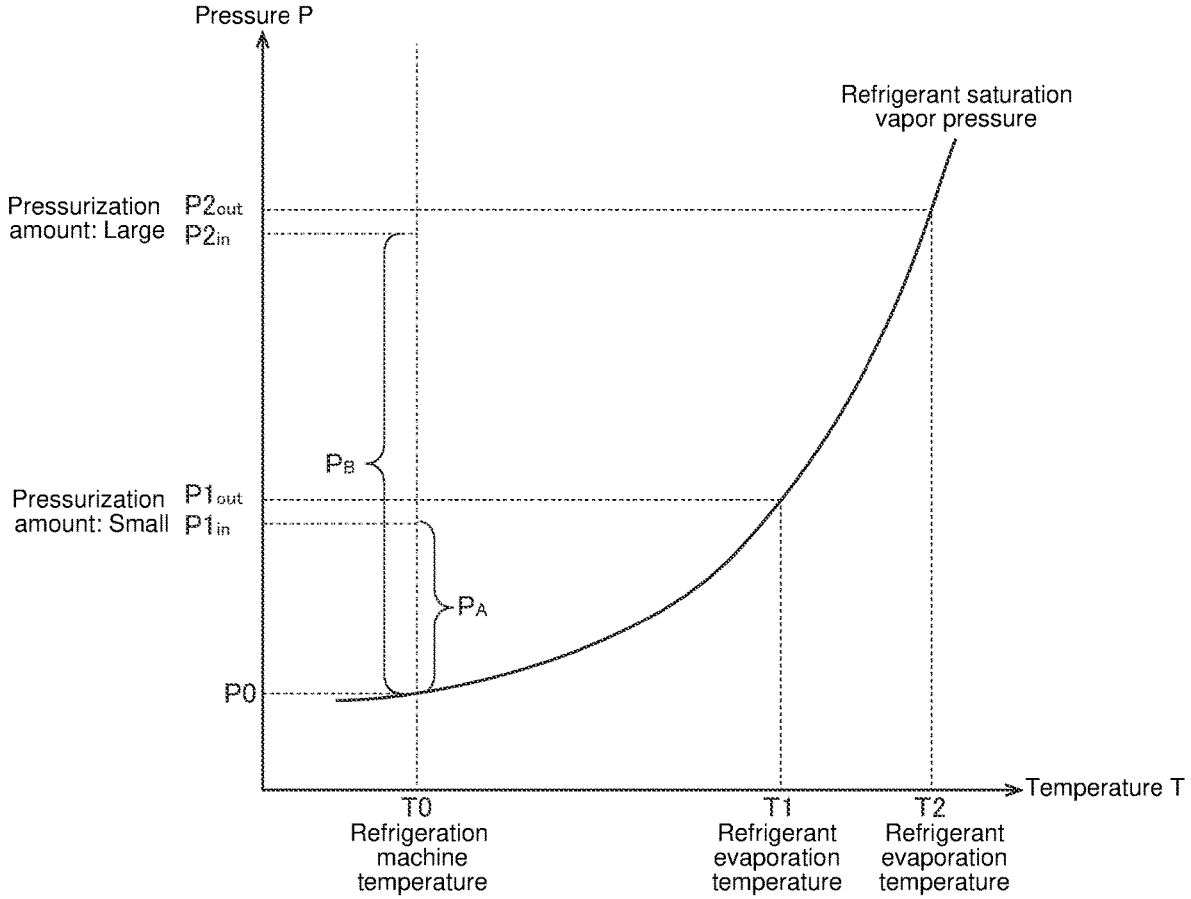
FIG. 4 is a graph showing the variation in the saturation vapor pressure of the refrigerant with respect to the refrigerant temperature in the cooling device according to one embodiment.

FIG. 4 is a graph showing the changes in the saturation vapor pressure with respect to the temperature of the refrigerant 101. In the graph shown in FIG. 4, the horizontal axis represents the temperature, and the vertical axis represents the pressure. In the graph in FIG. 4, P0 indicates the saturation pressure of the refrigerant 101 at the temperature T0 cooled by the refrigeration machine 4*a*, $P_A$ indicates the pressure (partial pressure) of the filler gas 6 in the gas phase portion 1*a* in the state in which the volume-changing unit 7 is contracted (see FIG. 2), $P1_{in}$ ($P1_{in}$=P0+$P_A$) indicates the pressure of the refrigerant 101 pressurized by the filler gas 6 at the pressure $P_A$ at the inlet of the pump 2, $P1_{out}$ indicates the pressure of the refrigerant 101 at the inlet of the pump 2 entered at the pressure $P1_{in}$, and T1 indicates the evaporation temperature of the refrigerant 101 at the pressure $P1_{out}$. As shown in FIG. 4, in the cooling device 100, the refrigerant 101 is pressurized at the pressure $P_A$ by the filler gas 6, so the pressure boost amount ($P1_{out}$-$P1_{in}$) of the refrigerant 101 by the pump 2 can be reduced when setting the refrigerant temperature of the refrigerant 101 to T1.

In the graph shown in FIG. 4, $P_B$ indicates the pressure (partial pressure) of the filler gas 6 in the gas phase portion 1*a* in the state in which the volume-changing unit 7 is extended (see FIG. 2), $P2_{in}$ indicates the pressure ($P2_{in}$=P0+$P_B$) of the refrigerant 101 pressurized by the filler gas 6 by the pressure $P_B$ at the inlet of the pump 2, and $P2_{out}$ indicates the pressure of the refrigerant 101 entered the pump 2 at pressure $P2_{in}$ at the outlet of the pump 2, and T2 indicates the evaporation temperature of the refrigerant 101 at the pressure $P2_{out}$. As shown in FIG. 4, in the cooling device 100, the refrigerant 101 is pressurized at the pressure $P_B$ by the filler gas 6, so the pressure boost amount ($P2_{out}$–$P2_{in}$) of the refrigerant 101 by the pump 2 can be reduced when setting the evaporation temperature of the refrigerant 101 to T2.

Effects of this Embodiment

In this embodiment, the following effects can be obtained.

In this embodiment, as described above, the cooling device 100 is equipped with the tank 1 for storing the liquid refrigerant 101, the pump 2 for discharging the liquid refrigerant 101 stored in the tank 1, the evaporator 3 for cooling the cooling target 200 by evaporating the liquid refrigerant 101 discharged from the pump 2, and the condenser 4 for condensing the gaseous refrigerant 101 evaporated in the evaporator 3. The gas phase portion 1*a* of the tank 1 is filled with the filler gas 6 and is equipped with the volume-changing unit 7 for adjusting the evaporation temperature of the refrigerant 101 by changing the pressure of the refrigerant 101 through the volume changes of the gas phase portion 1*a*.

As described above, the filler gas 6 is charged into the gas phase portion 1*a* of the tank 1. With this, it becomes possible to increase the pressure of the refrigerant 101 by the pressure (partial pressure) of the filler gas 6 sealed in the gas phase portion 1*a* of the tank 1. Therefore, the pressure boost amount (pressure increase amount) of the refrigerant 101 by the pump 2 can be reduced by the pressure (partial pressure) of the filler gas 6. As a result, the pump 2 can be made smaller. As described above, the volume-changing unit 7 is provided in the gas phase portion 1*a* of the tank 1 to adjust the evaporation temperature of refrigerant 101.

This adjustment is achieved by changing the pressure of the filler gas 6, thereby changing the pressure of the refrigerant 101 through the changes in the volume of the gas phase portion 1*a*. With this, it becomes possible to adjust the cooling temperature by adjusting the evaporation temperature of the refrigerant 101 by the volume-changing unit 7 and the filler gas 6. As a result, in two-phase cooling that utilizes the phase changes of the refrigerant 101 from liquid to gas, it is possible to adjust the cooling temperature while reducing the size of the pump 2. Note that in the case of using the refrigerant (such as carbon dioxide) with a large increase rate of the saturation pressure relative to the temperature increase, the pressure boost amount of the refrigerant 101 by the pump 2 tends to become larger. For this reason, this configuration is particularly effective when using a refrigerant 101, such as carbon dioxide, with a large increase in the saturation pressure relative to the temperature increase.

Further, in order to adjust the evaporation temperature of the refrigerant 101, it may be conceivable to pressurize the refrigerant 101 with an accumulator. However, in this case, the accumulator needs to pressurize the liquid refrigerant 101. This is because even if the accumulator pressurizes the gaseous refrigerant 101, the refrigerant 101 does not change from gas to liquid. Therefore, the pressure of the refrigerant 101 cannot be adjusted. Further, when pressurizing the liquid refrigerant 101, the size of the accumulator as a pressurization mechanism tends to increase. In contrast, as described above, the volume-changing unit 7 is provided in the gas phase portion 1*a* of the tank 1 to adjust the evaporation temperature of the refrigerant 101 by changing the pressure of the filler gas 6, which in turn changes the pressure of the refrigerant 101 through the volume change in the gas phase portion 1*a*. With this, by changing the volume of the gas phase portion 1*a* by the volume-changing unit 7, the pressure of the filler gas 6 is changed to change the pressure of the refrigerant 101. Therefore, as compared with the case in which the liquid refrigerant 101 is directly pressurized by the volume-changing unit 7, the size of the volume-changing unit 7 as a pressurization mechanism can be reduced.

Further, it is conceivable to adjust the pressure of the filler gas 6 by charging and discharging the filler gas 6 in the tank 1 in order to adjust the refrigerant evaporation temperature of the refrigerant 101. However, in this case, it is difficult to charge and discharge the filler gas 6 independently from the refrigerant 101. In contrast, as described above, the volume-changing unit 7 is provided in the gas phase portion 1*a* of the tank 1 to adjust the evaporation temperature of the refrigerant 101 by changing the pressure of the filler gas 6, which in turn changes the pressure of the refrigerant 101 through the volume changes in the gas phase portion 1*a*. This eliminates the need to charge and discharge the filler gas 6 in the tank 1 to adjust the evaporation temperature of the refrigerant 101. Therefore, unlike the case of charging and discharging the filler gas 6 in the tank 1, it is possible to prevent the refrigerant 101 from leaving the tank 1 along with the filler gas 6.

Further, in the above embodiment, the following further effects can be obtained by configuring as follows.

In other words, in this embodiment, the volume-changing unit 7 is configured to expand and contract by the volume-changing gas 8 to change its volume, thereby changing the volume of the gas phase portion 1*a*. With this, it is possible to change the volume of the gas phase portion 1*a* by simply expanding and contracting the volume-changing unit 7 with the volume-changing gas 8. Therefore, it is possible to adjust the evaporation temperature of the refrigerant 101 by changing the volume of the gas phase portion 1*a* with a simple configuration.

In this embodiment, as described above, the volume-changing unit 7 is configured to change the volume of the gas phase portion 1*a* so that the volume of the gas phase portion 1*a* decreases. This is achieved by increasing the volume of the volume-changing unit 7, causing it to deform and expand when the volume-changing gas 8 is supplied from the gas source 9 into the interior of the volume-changing unit 7. Conversely, the volume-changing unit 7 is configured to change the volume of the gas phase portion 1*a* so that the volume of the gas phase portion 1*a* increases. This is achieved by decreasing the volume of the volume-changing unit 7, causing it to deform and contract when the volume-changing gas 8 is discharged from the interior to the exterior. With this, when the volume-changing gas 8 is supplied from the gas source 9 to the interior of the volume-changing unit 7, it is possible to easily increase the evaporation temperature of the refrigerant 101 by increasing the pressure of the filler gas 6 and the pressure of the refrigerant 101. Further, when the volume-changing gas 8 is discharged from the interior of the volume-changing unit 7 to the exterior, it is possible to easily reduce the evaporation temperature of the refrigerant 101 by decreasing the pressure of the filler gas 6 and the pressure of the refrigerant 101.

Further, in this embodiment, as described above, the volume-changing unit 7 is configured to adjust the evaporation temperature of the refrigerant 101 by changing the volume of the gas phase portion 1*a* through the volume changes of the volume-changing gas 8 so that the temperature of the evaporator 3 or the temperature of the refrigerant 101 in the evaporator 3 becomes the target temperature. With this, it is possible to adjust the evaporation temperature of the refrigerant 101 by the volume-changing unit 7 according to the target temperature, so that the temperature of the evaporator 3 or the refrigerant 101 in the evaporator 3 can be easily and reliably adjusted to the target temperature.

Further, in this embodiment, as described above, the volume-changing unit 7 is a metal bellows. With this, as compared to the case in which the volume-changing unit 7 is a rubber balloon or the like, it can easily withstand high pressure, and thus the pressure can be easily regulated even with a high-pressure refrigerant 101. Further, since the volume-changing unit 7 is a metal bellows, unlike the case in which the volume-changing unit 7 is composed of a piston and a cylinder, there is no need for a sealing structure typically required between the piston and the cylinder. Therefore, the volume-changing unit 7 can be constructed with a simple structure.

Further, in this embodiment, as described above, the filler gas 6 is an inert gas that neither reacts with the refrigerant 101 nor condenses due to the volume changes in the gas phase portion 1*a* caused by the volume-changing unit 7. With this, the filler gas 6 can be stably positioned in the gas phase portion 1*a* of the tank 1. Further, since the filler gas 6 does not change in the amount (does not condense) even with the volume changes in the gas phase portion 1*a* caused by the volume-changing unit 7, the pressure effects of the filler gas 6 can be assuredly exerted, regardless of any volume changes in the gas phase portion 1*a* by the volume-changing unit 7."

Further, in this embodiment, as described above, the filler gas 6 includes nitrogen. With this, it becomes possible to easily realize the filler gas 6 that neither reacts with the refrigerant 101 nor condenses due to the volume changes in the gas phase portion 1*a* caused by the volume-changing unit 7.

Further, in this embodiment, as described above, the volume-changing unit 7 is mounted on the ceiling 1*c* of the tank 1. With this, it is possible to easily position the volume-changing unit 7 in a position that avoids the liquid phase portion 1*b* of the tank 1. Therefore, it is possible to easily change the volume of the gas phase portion 1*a* of the tank 1 with the volume-changing unit 7.

Modifications

Note that the embodiments disclosed here should be considered illustrative and not restrictive in all respects. It should be noted that the scope of the present invention is indicated by claims and is intended to include all modifications (modified examples) within the meaning and scope of the claims and equivalents.

For example, the above embodiment shows an example in which the refrigerant is carbon dioxide, but the present invention is not limited thereto. In the present invention, the refrigerant may be a freon refrigerant or a natural refrigerant such as ammonia other than carbon dioxide.

Further, in the above embodiment, an example is shown in which the filler gas is nitrogen, but the invention is not limited thereto. In the present invention, the filler gas may be argon.

Further, in the above embodiment, an example is shown in which the volume-changing gas is nitrogen, but the present invention is not limited thereto. In the present invention, the volume-changing gas may be a gas other than nitrogen.

Further, in the above embodiment, an example is shown in which the volume-changing unit is a metal bellows, but the present invention is not limited thereto. In the present invention, the volume-changing unit may be a bellows other than a metal bellows. Further, the volume-changing unit may be a rubber balloon that can be expanded and contracted by a volume-changing gas, and a cylinder structure in which a volume-changing gas moves a piston within the cylinder. However, from the standpoint of pressure resistance, it is preferable that the volume-changing unit be a metal bellows rather than a rubber balloon. Further, from the viewpoint of simplifying the structure, it is preferable that the volume-changing unit be a metal bellows rather than a cylinder structure that requires a sealing structure between the piston and the cylinder.

Further, in the above embodiment, an example is shown in which the volume-changing unit is mounted on the ceiling of the tank, but the present invention is not limited thereto. In the present invention, the volume-changing unit may be mounted on the side of the tank.

Further, in the above embodiment, an example is shown in which a gas supply valve for supplying a volume-changing gas to the volume-changing unit and a gas discharge valve for discharging the volume-changing gas from the volume-changing unit are provided, respectively, but the present invention is not limited thereto. In the present invention, a gas supply and discharge valve may be provided to supply a volume-changing gas to the volume-changing unit and to discharge the volume-changing gas from the volume-changing unit.

Aspects

It would be understood by those skilled in the art that the exemplary embodiments described above are specific examples of the following aspects.

(Item 1)

A cooling device comprising:

a tank configured to store a liquid refrigerant;

a pump configured to discharge the liquid refrigerant stored in the tank;

an evaporator configured to cool a cooling target by evaporating the liquid refrigerant discharged from the pump; and a condenser configured to condense a gaseous refrigerant generated by the refrigerant evaporated by the evaporator, wherein a gas phase portion of the tank is filled with a filler gas and is equipped with a volume-changing unit, the volume-changing unit being configured to adjust an evaporation temperature of the refrigerant by changing a pressure of the refrigerant, which is achieved by changing a volume of the gas phase portion to change a pressure of the filler gas.

(Item 2)

The cooling device as recited in the above-described Item 1, wherein the volume-changing unit is configured to change the volume of the gas phase portion by changing a volume of the volume-changing unit by being expanded and contracted by a volume-changing gas.

(Item 3)

The cooling device as recited in the above-described Item 2, wherein the volume-changing unit is configured to change the volume of the gas phase portion so that the volume of the gas phase portion reduces by being deformed to stretch and increase in volume when the volume-changing gas is supplied into an interior of the volume-changing unit from a gas source, and change the volume of the gas phase portion so that the volume of the gas phase portion increases by being deformed to contract and decrease in volume when the volume-changing gas is discharged from the interior of the volume-changing unit to an exterior of the volume-changing unit.

(Item 4)

The cooling device as recited in the above-described Item 2 or 3, wherein the volume-changing unit is configured to adjust the evaporation temperature of the refrigerant by changing the volume of the gas phase portion, which is achieved by changing the volume of the volume-changing unit by the volume-changing gas so that a temperature of the evaporator or a temperature of the refrigerant in the evaporator reaches a target temperature.

(Item 5)

The cooling device as recited in any one of the above-described Items 1 to 4, wherein the volume-changing unit is a metal bellows.

(Item 6)

The cooling device as recited in any one of the above-described Items 1 to 5, wherein the filler gas is an inert gas that neither reacts with the refrigerant nor condenses due to volume changes of the gas phase portion by the volume-changing unit.

(Item 7)

The cooling device as recited in the above-described Item 6, wherein the filler gas includes at least one of nitrogen and argon.

(Item 8)

The cooling device as recited in any one of the above-described Items 1 to 7, wherein the volume-changing unit is mounted on a ceiling of the tank.

DESCRIPTION OF REFERENCE SYMBOLS

1. Tank
1*a*: Gas phase portion
1*b*: Ceiling
2: Pump
3: Evaporator
4: Condenser
6: Filler gas
7: Volume-changing unit
8: Volume-changing gas
9: Gas source
100: Cooling device
101: Refrigerant
200: Cooling target

The invention claimed is:

1. A cooling device comprising:

a tank configured to store a liquid refrigerant;

a pump configured to discharge the liquid refrigerant stored in the tank;

an evaporator configured to cool a cooling target by evaporating the liquid refrigerant discharged from the pump; and a condenser configured to condense a gaseous refrigerant generated by the refrigerant evaporated by the evaporator, wherein a gas phase portion of the tank is filled with a filler gas and is equipped with a volume-changing unit, the volume-changing unit being configured to adjust an evaporation temperature of the refrigerant by changing a pressure of the refrigerant, which is achieved by changing a volume of the gas phase portion to change a pressure of the filler gas.

2. The cooling device as recited in claim 1, wherein the volume-changing unit is configured to change the volume of the gas phase portion by changing a volume of the volume-changing unit by being expanded and contracted by a volume-changing gas.

3. The cooling device as recited in claim 2, wherein the volume-changing unit is configured to change the volume of the gas phase portion so that the volume of the gas phase portion reduces by the volume-changing unit being deformed to stretch and increase in volume when the volume-changing gas is supplied into an interior of the volume-changing unit from a gas source, and change the volume of the gas phase portion so that the volume of the gas phase portion increases by the-volume changing unit being deformed to contract and decrease in volume when the volume-changing gas is discharged from the interior of the volume-changing unit to an exterior of the volume-changing unit.

4. The cooling device as recited in claim 2, wherein the volume-changing unit is configured to adjust the evaporation temperature of the refrigerant by changing the volume of the gas phase portion, which is achieved by changing the volume of the volume-changing unit by the volume-changing gas so that a temperature of the evaporator or a temperature of the refrigerant in the evaporator reaches a target temperature.

5. The cooling device as recited in claim 1, wherein the volume-changing unit is a metal bellows.

6. The cooling device as recited in claim 1, wherein the filler gas is an inert gas that neither reacts with the refrigerant nor condenses due to volume changes of the gas phase portion by the volume-changing unit.

7. The cooling device as recited in claim 6, wherein the filler gas includes at least one of nitrogen and argon.

8. The cooling device as recited in claim 1, wherein the volume-changing unit is mounted on a ceiling of the tank.

* * * * *